US007320372B2

(12) United States Patent
Falgout, Sr.

(10) Patent No.: US 7,320,372 B2
(45) Date of Patent: Jan. 22, 2008

(54) JET ASSISTED DRILLING METHOD

(76) Inventor: Thomas E. Falgout, Sr., 110 Charles Read St., Lafayette, LA (US) 70503

( * ) Notice: Subject to any disclaimer, the term of this patent is extended or adjusted under 35 U.S.C. 154(b) by 245 days.

(21) Appl. No.: 11/051,841

(22) Filed: Feb. 5, 2005

(65) Prior Publication Data

US 2006/0175094 A1 Aug. 10, 2006

(51) Int. Cl.
*E21B 7/08* (2006.01)
*E21B 7/18* (2006.01)

(52) U.S. Cl. ..... 175/61; 175/67; 175/73; 175/424; 175/45

(58) Field of Classification Search ..... 175/61, 175/67, 73, 424, 45
See application file for complete search history.

(56) References Cited

U.S. PATENT DOCUMENTS 5,253,721 A * 10/1993 Lee ..... 175/73
5,875,859 A * 3/1999 Ikeda et al. ..... 175/73
6,109,370 A * 8/2000 Gray ..... 175/61
6,206,112 B1 * 3/2001 Dickinson, III et al. ..... 175/67
6,659,201 B2 * 12/2003 Head et al. ..... 175/61
2003/0164253 A1 * 9/2003 Trueman et al. ..... 175/67

* cited by examiner

*Primary Examiner*—David Bagnell
*Assistant Examiner*—Robert Fuller
(74) *Attorney, Agent, or Firm*—John D. Jeter

(57) ABSTRACT

The drill string is fitted for drilling activity in the formation expected, including a jet nozzle equipped drill head, and a near bit kick sub. The drill string is deflected to change the progressing well bore to a preferred direction. After the change in well bore direction is accomplished by jetting, the kick sub is straightened and drilling proceeds along the new well bore center line. Ideally, the kick sub responds to direction from the surface and produces a change in drilling fluid pressure at the surface to indicate which mode, straight or deflected, is being carried out down hole.

12 Claims, 2 Drawing Sheets

PRIOR ART

JET ASSISTED DRILLING METHOD

This invention pertains to drilling wells in formations soft enough for jets to influence the direction of a progressing well bore. Drilling fluid is projected from the drill head in a direction along the axis of the lower end of the drill string. A kick sub is situated in the bottom hole assembly to deflect the axis of the lower end of the drill string, The kick sub is controllable from the surface to dictate the straight or bent configuration down hole. The direction of the progressing well bore is laterally influenced by actions taken at the surface.

BACKGROUND OF THE INVENTION

Some formations are so soft that the weight of the drill string will push the drill head along a generally vertical axis without drill bit rotation. It is usually preferred to use a drill bit, with rock cutting structure, as a drill head. Drill bits usually have a plurality of jets that project, with slight divergence, along the axis of the drill string. To influence lateral control of the progressing well bore, one jet may be larger than other jets on the bit. When the drill string is not rotated, the large jet softens the formation more on the related side of the bit and the bit drifts toward the softer side. The large jet is usually oriented relative to a selected reference until some formation is displaced or softened, then the drill bit is rotated to follow through the direction influenced by the large jet. When the lateral influence has served the purpose, further lateral influence of the large jet can be nullified by rotating the drill string.

The use of jets to laterally influence the course of an advancing drill bit has included jets that project laterally to push the drill bit laterally. That arrangement, seldom used now, permitted optimum drilling jet arrangements in the drill bit and offers some advantage when harder formations are encountered. The drilling fluid lost through the lateral jet, however, reduces the possible benefit the extra fluid could provide if directed through the regular bit jets.

Considerable research and experience has evolved the optimum sizing and placement of the jets in the drill bit. Considerable penetration rate can be lost by compromising the optimum bit jet arrangement, when harder formations are encountered while drilling. If optimum bit jet arrangements are used in soft formations, the drill string my not have to be tripped to change the jets when harder formations are encountered. There is considerable advantage in providing an alternate way to urge the drill string to proceed along a laterally changing center line.

Some definitions are in order. Oil field parlance currently defines making well bore with jets, and little or no drill bit influence, as "jetting ahead". Making well bore with a rotating drill bit is referred to as "drilling ahead". In any case, the circulation of drilling fluid to remove cuttings, or debris, is taken for granted.

A drill head is the lower terminal of a drill string. The drill head is usually a drill bit of some form but, for use in very soft formations, it may be the equivalent of a bull plug. The drill head will usually have some form of nozzle to project a jet of drilling fluid.

Drilling fluid circulation is essential to well bore debris removal, and jet nozzles usually project a drilling fluid stream with characteristics adapted to the situation to minimize re-grinding of cuttings by the drill head. Such jets can be defined as circulation jets. Nozzle arrangements adapted to influence the course of a progressing well bore usually sacrifice some well bore cleaning ability and may be called lateral influence nozzles.

Several terms are used in the oil field to define a well bore axis at a particular location. The term "angle" is usually the angular difference between the earth vertical and the axis of the well bore. The term "direction" can be expressed in the aviators form (0 to 360 deg) or the maritime form in defined degrees from a prime earth compass direction. The term "course" related to the well bore indicates that both angle and direction is considered, but may not be quantified. The term "course" may be used without qualifiers when only change in the course is the primary consideration.

SUMMARY OF THE INVENTION

A drill string is fitted out for drilling, with optimum bit jet arrangements, with a kick sub just above the drill bit. When conditions indicate the need for changing the direction of the progressing well bore, the kick sub is actuated, rotationally orientated, and the drill string is advanced along a line laterally changing from the original well center line. When the lateral influence is no longer needed, the kick sub is straightened. The drill string can be rotated to drill ahead. As an option, the mode of operation of apparatus down hole is determined by signals generated at the general area of the drill head, detectable at the surface.

These and other objects, advantages, and features of this invention will be apparent to those skilled in the art from a consideration of this specification, including the attached claims and appended drawings

DETAILED DESCRIPTION OF DRAWINGS

In the formal drawings, features that are well established in the art and do not bear upon points of novelty are omitted in the interest of descriptive clarity. Such omitted features may include threaded junctures, weld lines, sealing elements, pins and brazed junctures. The omitted features are well known to those skilled in the related art.

Figure 1:
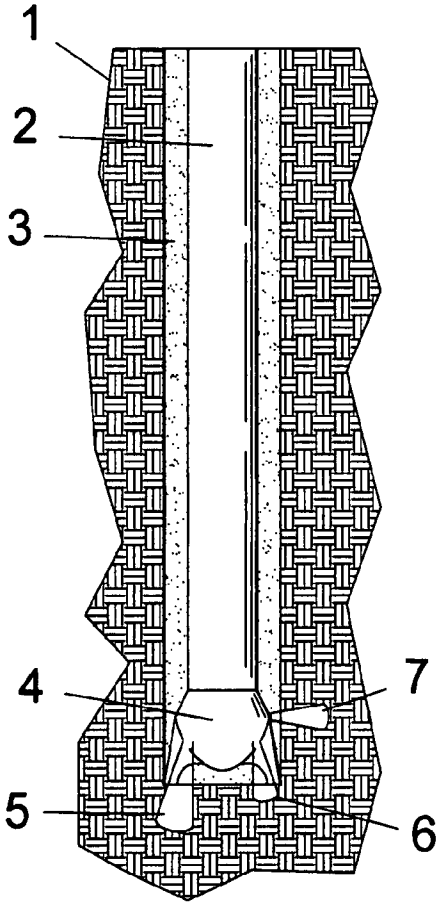
PRIOR ART FIG 1
FIG. 1 is a side view of a section of formation penetrated by a well bore in which a drill string, by prior art processes, is situated.

FIG. 1, according to prior art, shows formation 1 with drill string 2 producing well bore 3 with drill bit 4 with enlarged jet 5 projecting along a line similar to that of similarly situated regular jet 6. There are normally two jets 6. The jets are usually equally distributed about the bit face. The larger jet softens the formation, inviting the bit to proceed in a direction tending to follow the jet 5.

Lateral jet 7 is optional but, if present, tends to push the bit along the direction of jet 5.

Figure 2:
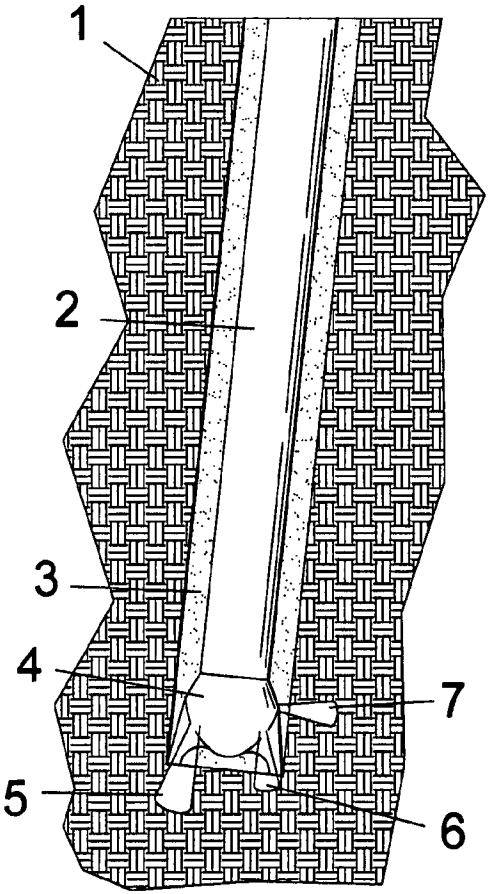
FIG. 2 is identical to the view of FIG. 1, with well bore deflected and drilling proceeding along a new center line.

FIG. 2 Shows all elements of FIG. 1, with the deflection of the well bore accomplished and drilling proceeding along the new well bore center line. To prevent further change of the well bore direction, the drill string is commonly rotated.

Figure 3:
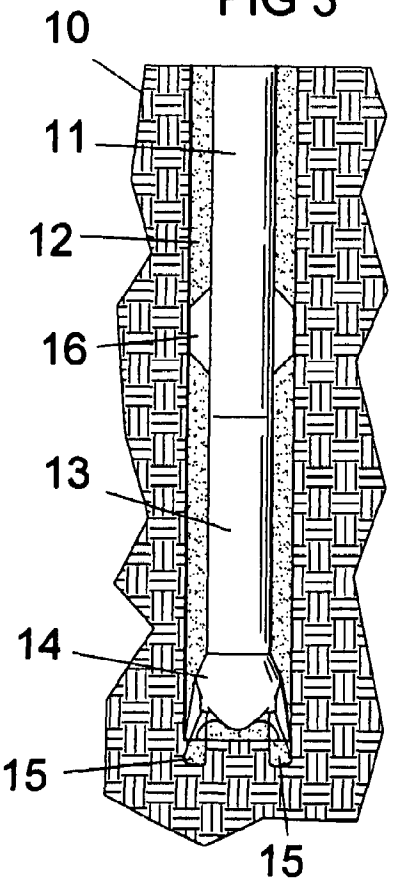
FIG. 3 is a side view, similar to FIG. 1 but using novel processes to deflect the well bore being drilled.

FIG. 3 shows the novel processes in use, with formation 10 being penetrated by drill string 11 to produce well bore 12. Kick sub 13 is situated near drill bit 14 which is fitted with the drilling fluid circulation nozzles to project jets 15. Jets 15 are abbreviated, and usually entail three jets projecting generally along the axis of the drill string. Each jet is usually directed outwardly from the drill string axis about ten degrees. The usual three jets are about equally distributed about the face of the drill bit. One stabilizer 16 is shown but use, placement, and number of stabilizers is optional.

Figure 4:
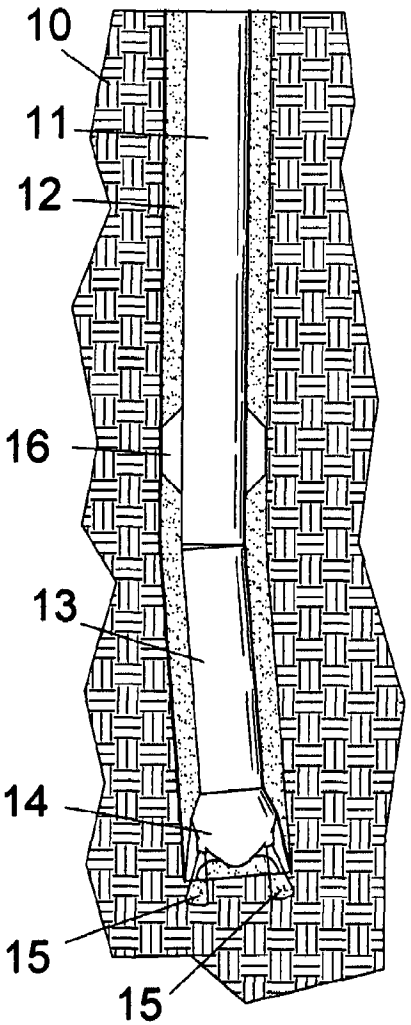
FIG. 4 is similar to FIG. 3, with the well bore deflection process underway.

FIG. 4 shows kick sub 13 actuated to laterally deflect the lower end of the drill string. With bit load applied, and the kick sub oriented as preferred, the well bore proceeds along a line approximating the axis of the lower end of the drill string.

Figure 5:
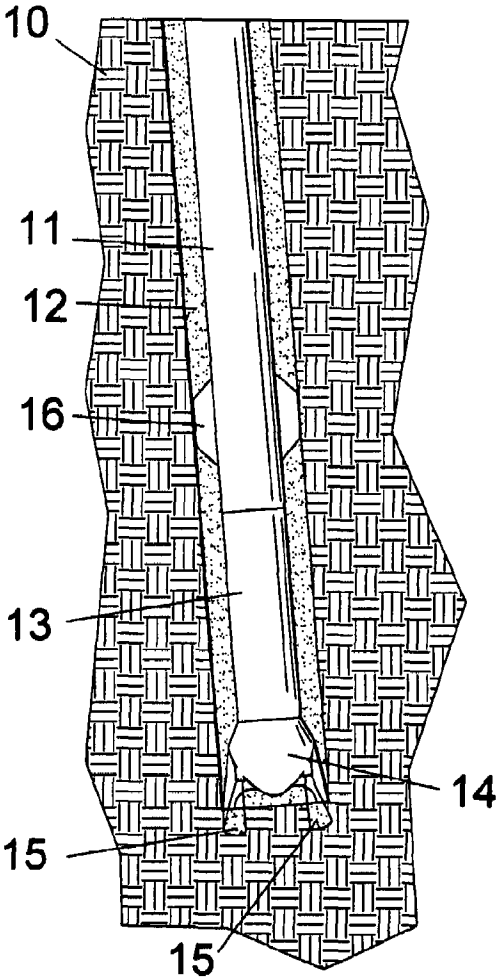
FIG. 5 is similar to FIG. 4, with the well bore deflected and drilling proceeding along a new center line.

FIG. 5 shows the well bore deflected as preferred, the kick sub straightened, and the drill bit proceeding to produce well bore along the new center line. The drill string is now usually rotated for optimum penetration rate.

Kick subs are almost useless unless they generate some change in operational features, such as pressure drop through the down hole assembly, that can be detected at the surface and used to indicate which mode of operation is active down hole.

Down hole drilling motors are commonly used in conjunction with kick subs. By the processes defined herein, motors can be used if desired. If the bottom hole assembly will drill through to harder formations in a single bit run, it is logical to fit out the bottom hole assembly for hard formation drilling.

From the foregoing, it will be seen that this invention is one well adapted to attain all of the ends and objects hereinabove set forth, together with other advantages which are obvious and which are inherent to the method.

It will be understood that certain features and sub-combinations are of utility and may be employed without reference to other features and sub-combinations. This is contemplated by and is within the scope of the claims.

As many possible embodiments may be made of the method of this invention without departing from the scope thereof, it is to be understood that all matter herein set forth or shown in the accompanying drawings is to be interpreted as illustrative and not in a limiting sense.

The invention having been described, I claim:

1. A method for deflecting the direction of a well bore being drilled, utilizing drill head jet nozzles and a kick sub, the method comprising:

a) assembling a drill string with a bottom hole assembly including a jet nozzle equipped drill head attached to a kick sub, the kick sub being attached to an upwardly continuing drill string;

b) suspending the drill string in a well bore and providing drilling fluid flow down the drill string bore;

c) deflecting the kick sub and jetting ahead to provide a length of well bore laterally displaced from the original well bore direction;

d) straightening the kick sub and drilling ahead along the deflected well bore direction; and e) wherein said deflecting comprises bending said bottom hole assembly.

2. The method according to claim 1 wherein the drill head comprises a drill bit.

3. The method according to claim 1 wherein the drill head comprises the equivalent of a bull plug fitted with a plurality of forwardly directed jet nozzles for direction and projection of a drilling fluid stream.

4. The method according to claim 1 wherein the kick sub is rotationally oriented to influence the preferred direction to be achieved by the changed direction of the progressing well bore.

5. The method according to claim 1 wherein a drilling motor is attached to the kick sub to drive the drill head rotationally.

6. The method according to claim 1 wherein said deflecting is determined by noting change in drilling fluid pressure at the surface.

7. The method according to claim 1 wherein said drilling ahead is accomplished without rotating the drill string.

8. A method for deflecting the direction of a well bore being drilled, utilizing a drill bit with jet nozzles and a kick sub, the method comprising:

a) assembling a drill string with a bottom hole assembly including a jet nozzle equipped drill bit attached to a kick sub, the kick sub being attached to an upwardly continuing drill string;

b) suspending the drill string in a well bore and providing drilling fluid flow down the drill string bore;

c) deflecting the kick sub and jetting ahead to provide a length of well bore laterally displaced from the original well bore direction; and d) straightening the kick sub and drilling ahead along the deflected well bore direction;

e) wherein said deflecting comprises bending said bottom hole assembly.

9. The method according to claim 8 wherein the kick sub is rotationally oriented to influence the preferred direction to be achieved by the changed direction of the progressing well bore.

10. The method according to claim 8 wherein a drilling motor is attached to the kick sub to drive the drill head rotationally.

11. The method according to claim 8 wherein the mode of operation of the down hole assembly is determined by noting change in drilling fluid pressure at the surface.

12. The method according to claim 8 wherein said drilling ahead is accomplished without rotating the drill string.

* * * * *